US010725396B2

(12) United States Patent
Kano

(10) Patent No.: US 10,725,396 B2
(45) Date of Patent: Jul. 28, 2020

(54) DEVELOPING DEVICE AND IMAGE FORMING APPARATUS

(71) Applicant: SHARP KABUSHIKI KAISHA, Sakai, Osaka (JP)

(72) Inventor: Tadanori Kano, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/399,326

(22) Filed: Apr. 30, 2019

(65) Prior Publication Data

US 2019/0361369 A1 Nov. 28, 2019

(30) Foreign Application Priority Data

May 28, 2018 (JP) ..... 2018-101774

(51) Int. Cl.
*G03G 15/06* (2006.01)

(52) U.S. Cl.
CPC ..... *G03G 15/065* (2013.01)

(58) Field of Classification Search
CPC .. G03G 15/065; G03G 15/08; G03G 15/0266; G03G 9/08
See application file for complete search history.

(56) References Cited

U.S. PATENT DOCUMENTS 4,990,960 A * 2/1991 Umetani ..... G03G 15/0126 399/134
5,550,626 A * 8/1996 Kobayashi ..... G03G 13/01 399/178

FOREIGN PATENT DOCUMENTS

JP 2003-149870 A 5/2003

* cited by examiner

*Primary Examiner* — Sandra Brase
(74) *Attorney, Agent, or Firm* — ScienBiziP, P.C.

(57) ABSTRACT

A developing device includes a first toner and a second toner that have different hues, an image carrier, a charging unit that charges the image carrier, and a potential controller that controls a potential of the charging unit. A first developing characteristic of the first toner and a second developing characteristic of the second toner have different slopes and intersect each other.

14 Claims, 8 Drawing Sheets

FIG. 6

| | EXTERNAL ADDITIVE | |
|---|---|---|
| | SILICA | TITANIUM OXIDE |
| CYAN TONER | 1.00 | 0.50 |
| MAGENTA TONER A | 1.00 | 0.50 |
| MAGENTA TONER B | 1.05 | 1.00 |

FIG. 7

| | | | | |
|---|---|---|---|---|
| | CYAN TONER | MAGENTA TONER A | MAGENTA TONER B | CARRIER |
| DEVELOPING AGENT 1 | 15.0 | 0.0 | 0.0 | 185.0 |
| DEVELOPING AGENT 2 | 0.0 | 15.0 | 0.0 | 185.0 |
| DEVELOPING AGENT 3 | 0.0 | 0.0 | 15.0 | 185.0 |
| DEVELOPING AGENT 4 | 7.5 | 7.5 | 0.0 | 185.0 |
| DEVELOPING AGENT 5 | 7.5 | 0.0 | 7.5 | 185.0 |

FIG. 8

| | IMAGE PROCESSING | MEASURED VALUE | | CALCULATED VALUE |
|---|---|---|---|---|
| | | GRAININESS | MOTTLE | Rc VALUE |
| EVALUATION EXAMPLE 1 | NO | 1.3492 | 0.5286 | 1.0246 |
| EVALUATION EXAMPLE 2 | DITHERING | 1.1617 | 0.4044 | 0.8698 |
| COMPARATIVE EXAMPLE 1 | NO | 1.6686 | 0.4675 | 1.2253 |
| COMPARATIVE EXAMPLE 2 | DITHERING | 1.7184 | 0.5667 | 1.2795 |

| | WEIGHT-AVERAGE MOLECULAR WEIGHT (Mw) | RESISTANCE ($\Omega \cdot cm^3$) | AMOUNT OF ELECTRIC CHARGE ($\mu C/g$) |
|---|---|---|---|
| TONER A | 50000 - 80000 | $4.5 \times 10^7$ | 27.1 |
| TONER B | 40000 - 70000 | $5.1 \times 10^7$ | 32.7 |

FIG. 13

| | CHANGE IN FORMULATION | RESISTANCE OF ORIGINAL TONER ($\Omega \cdot cm^3$) | RESISTANCE OF CHANGED TONER ($\Omega \cdot cm^3$) |
|---|---|---|---|
| FORMULATION 1 | INCREASE IN WEIGHT-AVERAGE MOLECULAR WEIGHT OF LOW-MOLECULAR-WEIGHT POLYESTER RESIN (INCREASE IN Mw BY 200) | $4.3 \times 10^7$ | $4.5 \times 10^7$ |
| FORMULATION 2 | DECREASE IN AMOUNT OF ESTER WAX (DECREASE BY 1%) | $4.5 \times 10^7$ | $4.9 \times 10^7$ |
| FORMULATION 3 | DECREASE IN AMOUNT OF CRYSTALLINE POLYESTER RESIN (DECREASE BY 6%) | $4.5 \times 10^7$ | $5.6 \times 10^7$ |
| FORMULATION 4 | INCREASE IN AMOUNT OF LOW-MOLECULAR-WEIGHT POLYESTER RESIN (INCREASE BY 20%) | $4.0 \times 10^7$ | $4.5 \times 10^7$ |

DEVELOPING DEVICE AND IMAGE FORMING APPARATUS

BACKGROUND

1. Field

The present disclosure relates to a developing device that uses two toners having different hues and an image forming apparatus.

2. Description of the Related Art

In known electrophotographic image forming apparatuses, various tinges are produced by superimposing a plurality of color toners having different hues, such as cyan, magenta, yellow, and black toners.

In the field of drafting and the like, the major application of image forming apparatuses is single-color printing. The single color used herein has a hue different from that of the above color toner and is thus produced by mixing two or more color toners. In recent years, an electro-photographic color toner obtained by mixing a plurality of toners has been proposed (e.g., refer to Japanese Unexamined Patent Application Publication No. 2003-149870).

SUMMARY

The electrophotographic color toner disclosed in Japanese Unexamined Patent Application Publication No. 2003-149870 is a color toner that is obtained by mixing two or more toners and that has a surface to which a surface modifier adheres. In the above electrophotographic color toner, the difference in the amount of electric charge is reduced by causing a surface modifier to adhere to the color toner obtained by performing mixing. However, it is difficult to make the amount of electric charge completely uniform in the mixing of toners, and partly non-uniform charging may cause unevenness of the hue.

In view of the foregoing, it is desirable to provide a developing device capable of producing a desired tinge by adjusting the development densities of two toners, and an image forming apparatus.

According to an aspect of the disclosure, there is provided a developing device including a first toner and a second toner that have different hues, an image carrier, a charging unit that charges the image carrier, and a potential controller that controls a potential of the charging unit. For the first toner and the second toner, when a correlation between a potential and a development density is assumed to be a developing characteristic, a developing characteristic of the first toner and a developing characteristic of the second toner have different slopes and intersect each other.

According to another: aspect of the disclosure, there is provided an image forming apparatus including the developing device.

BRIEF DESCRIPTION OF THE DRAWINGS

FIG. 6 is a characteristic table showing the formulation of each toner;

FIG. 7 is a characteristic table showing the composition of each developing agent;

FIG. 8 is a characteristic table showing the evaluation results of output images;

FIG. 13 is a characteristic table showing the formulation of each toner in a developing device according to a third embodiment of the present disclosure.

DESCRIPTION OF THE EMBODIMENTS

First Embodiment

Hereafter, an image forming apparatus and a developing device according to a first embodiment of the present disclosure will be described with reference to the attached drawings.

Figure 1:
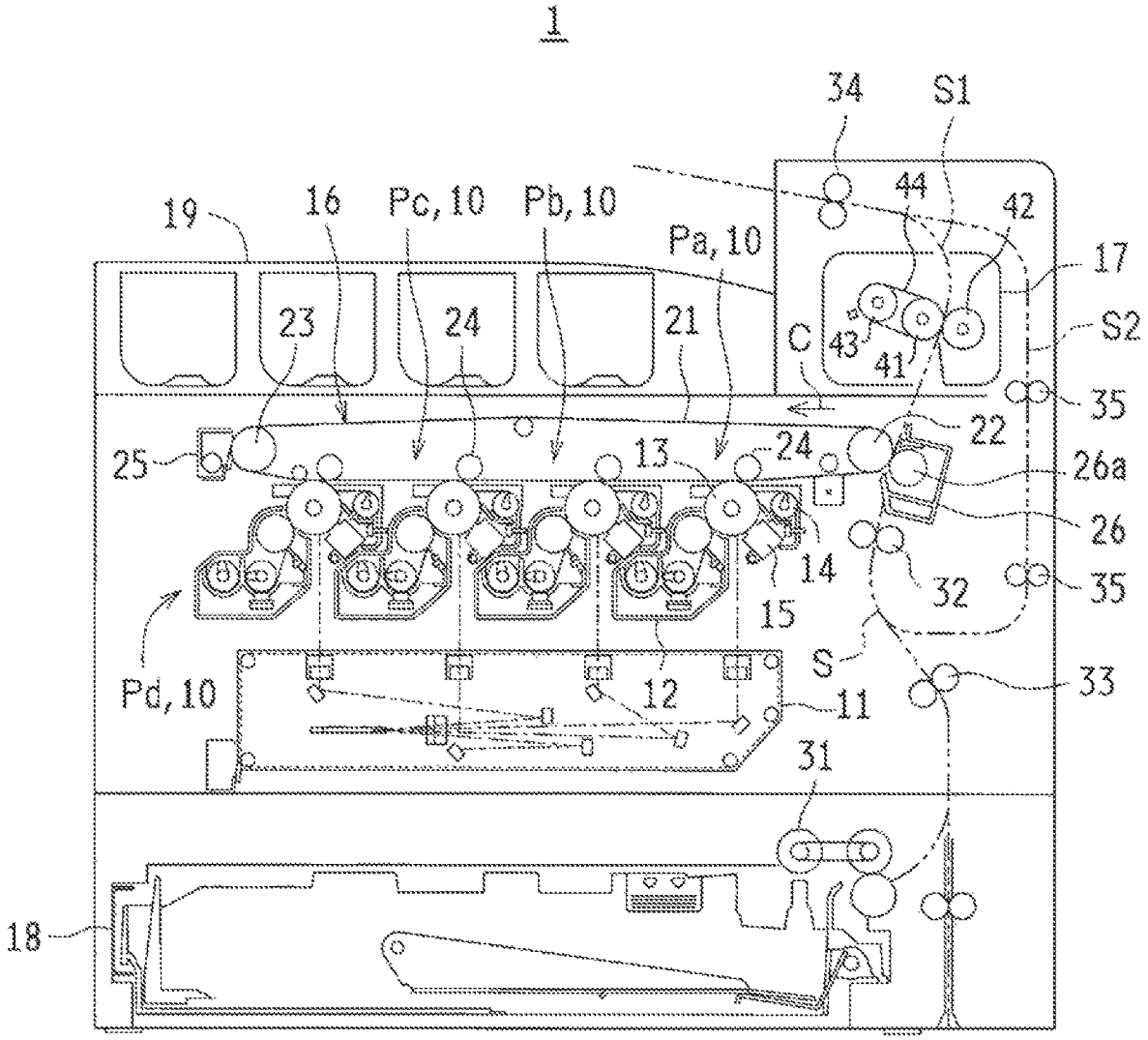
FIG. 1 is a schematic side view of an image forming apparatus according to a first embodiment of the present disclosure.

FIG. 1 is a schematic side view of an image forming apparatus according to a first embodiment of the Present disclosure.

The image forming apparatus 1 according to the first embodiment of the present disclosure includes an exposing unit 11, an image forming section 12, a photoconductor drum 13, a cleaning unit 14, a charging unit 15, an intermediate transfer belt unit 16, a fixing unit 17, a sheet feed tray 18, a sheet output tray 19, and a sheet conveyance path S. The image forming apparatus 1 is configured to form a multicolor image or a single-color image on a predetermined paper sheet in response to image data transmitted from the outside.

The image data treated in the image forming apparatus 1 corresponds to a color image formed by using colors of black (K), cyan (C), magenta (M), and yellow (Y). Therefore, four image stations Pa, Pb, Pc, and Pd (developing devices 10) each including the image forming section 12, the photoconductor drum 13, the charging unit 15, and the cleaning unit 14 are provided so as to form four latent images corresponding to black, cyan, magenta, and yellow.

The photoconductor drum 13 (one example of image carriers) is disposed substantially at the center of the image forming apparatus 1. The charging unit 15 is configured to uniformly charge a surface of the photoconductor drum 13 to a particular potential. The exposing unit 11 is configured to expose the surface of the photoconductor drum 13 to form an electrostatic latent image. The image forming section 12 is configured to develop the electrostatic latent image on the surface of the photoconductor drum 13 to form a toner image on the surface of the photoconductor drum 13. Through the above-described series of operations, a toner image of each color is formed on the surface of the corresponding photoconductor drum 13. The cleaning unit 14 is configured to remove and collect a residual toner on the surface of the photoconductor drum 13 after development and image transfer. In the developing device 10, a toner of the corresponding color is supplied from a cartridge. The toner will be described in detail later with reference to, for example, FIG. 2.

The intermediate transfer belt unit 16 is disposed on the upper side of the photoconductor drum 13 and includes an intermediate transfer belt 21, an intermediate transfer belt driving roller 22, an intermediate transfer belt driven roller 23, intermediate transfer rollers 24, and an intermediate transfer belt cleaning unit 25. The intermediate transfer rollers 24 are disposed so as to correspond to the four YMCK image stations.

The intermediate transfer belt driving roller 22, the intermediate transfer belt driven roller 23, and the intermediate transfer rollers 24 are configured to move a surface of the intermediate transfer belt 21 in a predetermined direction (a direction indicated by arrow C in the drawing) while stretching the intermediate transfer belt 21.

The intermediate transfer belt 21 rotates in the direction indicated by arrow C. A residual toner is removed and collected by the intermediate transfer belt cleaning unit 25. The toner images of the corresponding colors formed on the surfaces of the photoconductor drums 13 are sequentially transferred in a superimposed manner to form a color toner image on the surface of the intermediate transfer belt 21.

The image forming apparatus 1 further includes a secondary transfer unit 26 including a transfer roller 26*a*. The transfer roller 26*a* and the intermediate transfer belt 21 have a nip region therebetween. A paper sheet conveyed through the sheet conveyance path S is nipped and conveyed in the nip region. When the paper sheet passes through the nip region, the toner image on the surface of the intermediate transfer belt 21 is transferred onto the paper sheet.

The sheet feed tray 18 is a tray for storing paper sheets used in image formation and is disposed on the lower side of the exposing unit 11. The sheet output tray 19 is a tray for placing paper sheets on which an image has been formed and is disposed on the upper side of the image forming apparatus 1.

The sheet conveyance path S is constituted by an S-shaped main path S1 and a reverse path S2 that branches in the middle of the main path S1 and returns to the main path S1. A pickup roller 31, a pre-registration roller 33, a registration roller 32, the secondary transfer unit 26, the fixing unit 17, and a sheet output roller 34 are disposed along the main path S1. The reverse path S2 branches at a position between the fixing unit 17 and the sheet output-roller 34 and returns to a position between the pre-registration roller 33 and the registration roller 32 via a plurality of conveyance rollers 35.

The pickup roller 31 is a draw-in roller disposed near the end portion of the sheet feed tray 18 and configured to feed paper sheets one by one from the sheet feed tray 18 to the sheet conveyance path S. The registration roller 32 is configured to temporarily hold a paper sheet conveyed from the sheet feed tray 18 and convey the paper sheet to the transfer roller 26*a* at a timing at which the leading end of the toner image on the photoconductor drum 13 is aligned with the leading end of the paper sheet. The pre-registration roller 33 is a small roller configured to promote and support the conveyance of paper sheets.

The fixing unit 17 is a belt fixing type unit and a fixing belt 44 is wound around a fixing roller 41 and a heating roller 43. In the fixing unit 17, a pressurizing roller 42 is pressed against the fixing roller 41 with the fixing belt 44 interposed therebetween. The fixing unit 17 is configured to receive a paper sheet on which an unfixed toner image has been formed and convey the paper sheet while the paper sheet is nipped between the fixing belt 44 and the pressurizing roller 42. The paper sheet after the fixation is discharged onto the paper output tray 19 by the sheet-output roller 34.

When an image is formed not only on a front-surface of the paper sheet but also on a rear surface of the paper sheet, the paper sheet is conveyed in a reverse direction from the sheet output roller 34 to the reverse path S2, turned over, and guided to the registration roller 32 again. Then, an image is formed on the rear surface in the same manner as that of the front surface, and the paper sheet is discharged onto the sheet output tray 19.

In the image forming apparatus 1, a color image is formed by superimposing a plurality of toner images. However, a single-color image may be formed by using a single toner image. In this case, the toner may be supplied from, a plurality of cartridges or a single cartridge.

For example, in the application of drafting, printing is mainly performed using a single blue color. Herein, the blue color is produced by mixing a cyan toner and a magenta toner. When the cyan toner and the magenta toner are simply mixed with each other, the same color toner is unevenly distributed with a low probability, which sometimes changes the tinge. Accordingly, in the present disclosure, the developing characteristics of two toners are differentiated by employing different formulations to produce a more uniform color. Next, the developing characteristics of two toners will be described with reference to FIG. 2 to FIG. 4.

Figure 2:
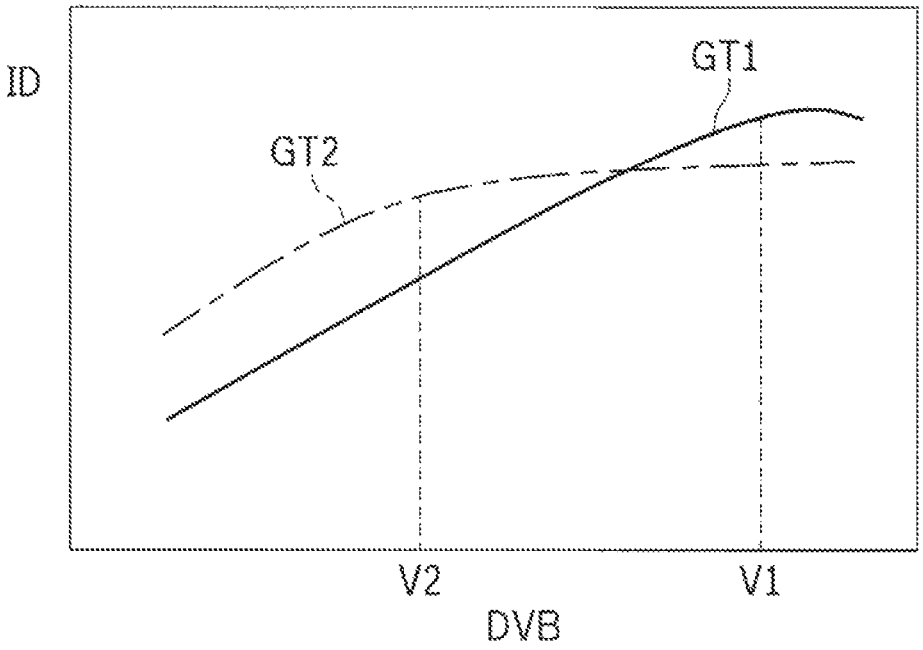
FIG. 2 is a characteristic diagram illustrating the developing characteristics of a first toner and a second toner.

FIG. 2 is a characteristic diagram, illustrating the developing characteristics of a first toner and a second toner.

The developing characteristic indicates the correlation between potential and development density. In FIG. 2, the horizontal axis shows a development bias potential (DVB), and the potential on the photoconductor drum 13 increases toward the right. The vertical axis shows the development density (ID), and the color density increases toward the top.

FIG. 2 illustrates the developing characteristics of a first toner TR1 and a second toner TR2 (refer to FIG. 5 described later) that have different hues. The first toner TR1 is, for example, a cyan toner and corresponds to a first developing characteristic GT1. The second toner TR2 is, for example, a magenta toner and corresponds to a second developing characteristic GT2. In the first developing characteristic GT1, the development density increases as the development bias potential increases. In the second developing characteristic GT2, the development density increases in proportion to the development bias potential as in the first developing characteristic GT1, but the slope is smaller than that in the first developing characteristic GT1. Specifically, when the development bias potential is low, the second developing characteristic GT2 has a higher development density than the first developing characteristic GT1. When the development bias potential is increased beyond a particular potential, the first developing characteristic GT1 has a higher development density than the second developing characteristic GT2, which means that the first developing characteristic GT1 and the second developing characteristic GT2 intersect each other. In the developing device 10, a particular potential at which the development density of the first toner TR1 is higher than that of the second toner TR2 is set to a first potential V1, and a particular potential at which the development density of the second toner TR2 is higher than that of the first toner TR1 is set to a second potential V2.

As described above, the developing characteristics of toners can be adjusted by changing their formulations. In this embodiment, the formulation of the second toner TR2 is changed based on the formulation of the first toner TR1. Next, the comparison of development densities before and after adjustment will be described for the first toner TR1 and the second toner: TR2.

Figure 3:
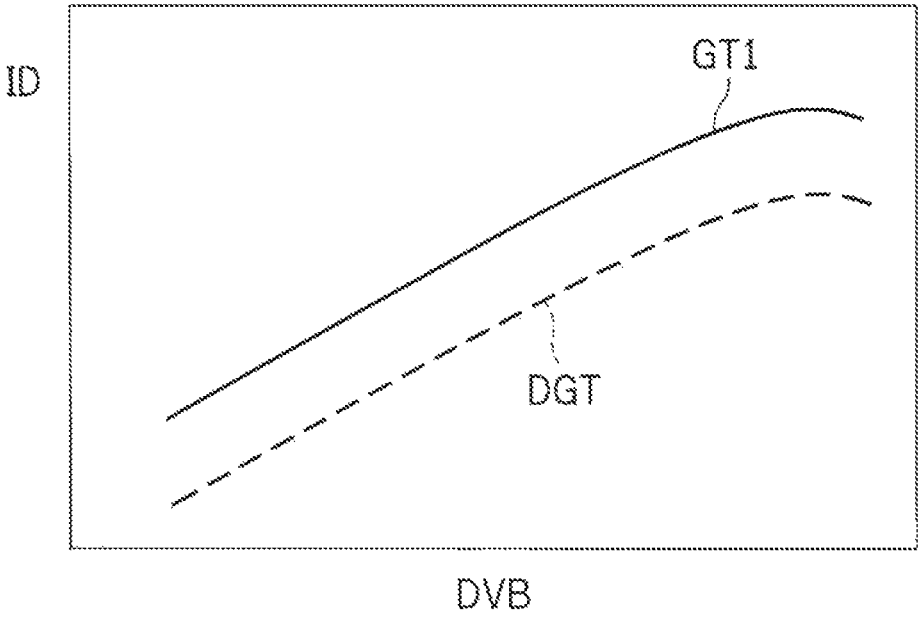
FIG. 3 is a characteristic diagram illustrating the developing characteristics of the first toner and a second toner before adjustment.
Figure 4:
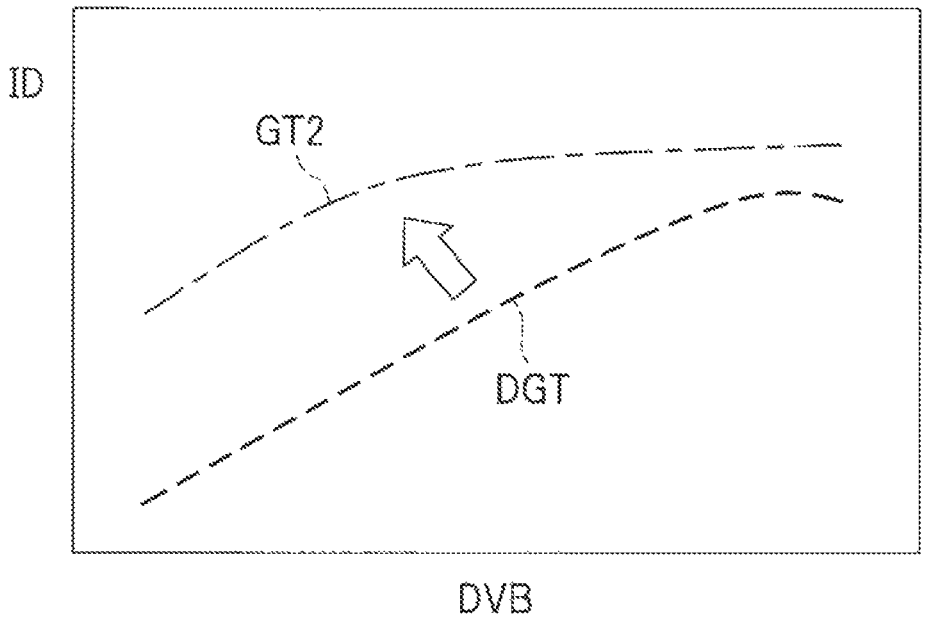
FIG. 4 is a characteristic diagram illustrating the developing characteristics of a second toner before and after adjustment.

FIG. 3 is a characteristic diagram illustrating the developing characteristics of the first toner and a second toner before adjustment. FIG. 4 is a characteristic diagram illustrating the developing characteristics of a second toner before and after adjustment.

FIG. 3 illustrates the developing characteristics of a first toner TR1 and a second toner TR2 that have the same formulation. The first developing characteristic GT1 is the same as that in FIG. 2. The developing characteristic DGT before adjustment indicates the developing characteristic of the second toner TR2 having the same formulation as the first toner TR1 and has substantially the same slope as the first developing characteristic GT1. In FIG. 3, the developing characteristic DGT before adjustment has a lower development density on the whole than the first developing characteristic GT1 in consideration of ease of understanding of the drawing, but the development density is not limited thereto. The developing characteristic DGT before adjustment and the first developing characteristic GT1 may nave substantially the same development density. The formulation of the toner will be described in detail with reference to FIG. 6 to FIG. 8 described later.

FIG. 4 illustrates the developing characteristic of a second toner TR2 having a formulation different from that of the first toner TR1. The developing characteristic is the same as the second developing characteristic GT2 in FIG. 2. In this embodiment, the formulation of the second toner TR2 is changed based on the formulation of the first toner TR1. Alternatively, the formulation of the first toner TR1 may be changed based on the formulation of the second toner TR2. In the following description, the second toner TR2 corresponding to the developing characteristic DGT before adjustment may be referred to as a "second toner before adjustment".

Next, the relationship between the potential on the photoconductor drum 13 and the state of toners in the case where toners having different developing characteristics are combined with each other will be described with reference to FIG. 5.

Figure 5:
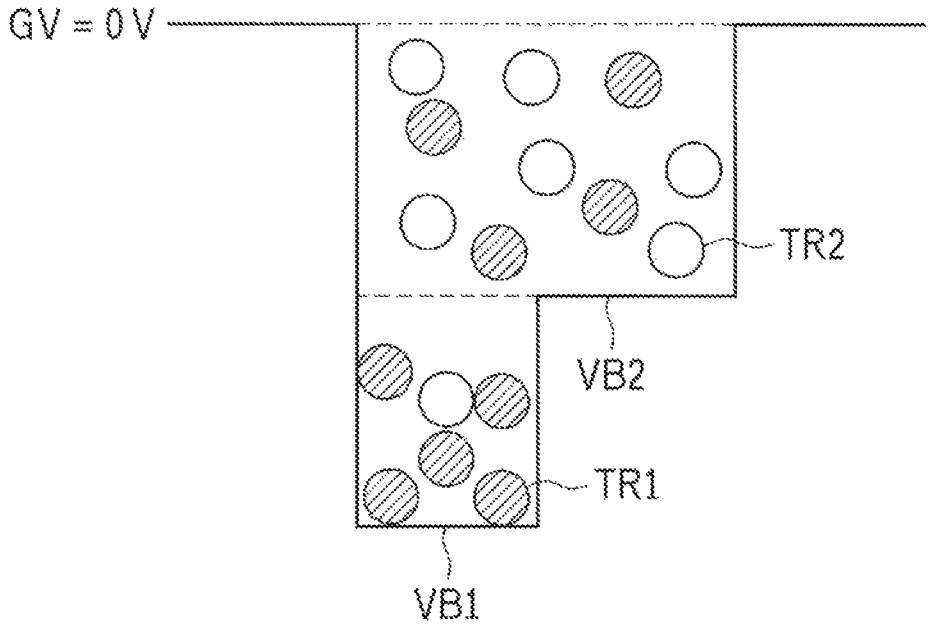
FIG. 5 schematically illustrates the relationship between the potential on a photoconductor arum and the state of toners.

FIG. 5 schematically illustrates the relationship between the potential on the photoconductor drum and the state of toners. In FIG. 5, the first toner TR1 is hatched to distinguish the first toner TR1 from the second toner TR2.

In FIG. 5, the upper horizontal straight line (GV=0 V) indicates that the potential on the photoconductor drum is 0 V, and the difference in potential increases toward a lower position. FIG. 5 illustrates a first bias potential VB1 that has the largest difference in potential with respect to 0 V and a second bias potential VB2 that has a medium difference in potential with respect to the first bias potential VB1.

The first bias potential VB1 in FIG. 5 corresponds to the first potential V1 in FIG. 2, and the second bias potential VB2 in FIG. 5 corresponds to the second potential V2 in FIG. 2. That is, the development density of the first toner TR1 is higher than that of the second toner TR2 in a section between the first bias potential VB1 and the second bias potential VB2 (solid section). Consequently, a larger amount of first toner TR1 adheres to the photoconductor drum 13, which provides a blue pixel with a strong cyan. The development density of the second toner TR2 is higher than that of the first toner TR1 in a section between the second bias potential VB2 and 0 V (halftone section). Consequently, a larger amount of second toner TR2 adheres to the photoconductor drum 13, which provides a blue pixel with a strong magenta.

The potential set in the developing device 10 is not limited to only the first potential V1 and the second potential V2. By gradually changing the potential, the gradation with varying hues can be expressed.

FIG. 6 is a characteristic table showing the formulation of each toner.

In this embodiment, toner particles are formed by dispersing a crystalline polyester resin in an amorphous polyester resin and contain a pigment corresponding to cyan or magenta. Furthermore, an external additive such as silica (small particle size silica) or titanium oxide (titania) is added to the toner particles. The silica (RX200 manufactured by NIPPON AEROSIL Co., Ltd.) has an average primary particle size of 12 nm. The titanium oxide (JMT-150F1 manufactured by TAYCA Corporation) has an average primary particle size of 15 nm.

FIG. 6 illustrates the formulations of three toners: a cyan toner, a magenta toner A, and a magenta toner B. The cyan toner is the first toner TR1 and corresponds to the first developing characteristic GT1. The magenta toner A is the second toner before adjustment and corresponds to the developing characteristic DGT before adjustment. The magenta toner B is the second toner TR2 and corresponds to the second developing characteristic GT2.

The cyan toner contains "1.00" part of silica and "0.50" parts of titanium, oxide. The magenta toner A contains "1.00" part of silica and "0.50" parts of titanium oxide as in the case of the cyan toner. The magenta toner B contains "1.05" parts of silica and "1.00" part of titanium oxide. The developing characteristics of the first toner TR1 and the second toner TR2 are differentiated by adding different amounts of small particle size silica. Thus, the developing characteristics can be easily changed by changing the amounts of external additives added to toners.

The external additive is not limited to the above-mentioned external additives. For example, fumed silica (VP RX40S manufactured by NIPPON AEROSIL Co., Ltd., primary particle size: 80 to 110 nm), colloidal silica (VP SX110 manufactured by NIPPON AEROSIL Co., Ltd., primary particle size: 110 nm), alumina (aluminum oxide) (C805 manufactured by NIPPON AEROSIL Co., Ltd., primary particle size: 13 nm), strontium titanate (SW-100 manufactured by Titan Kogyo, Ltd., primary particle size: 70 nm), and resin fine particles (FNN-7611 manufactured by FUJIKURA KASEI Co., Ltd., primary particle size: 100 nm).

FIG. 7 is a characteristic table showing the composition of each developing agent.

In the developing device 10, the toners illustrated in FIG. 6 and a carrier are mixed with each other to prepare a developing agent, which is accommodated in a cartridge. In this embodiment, five developing agents 1 to 5 were prepared for evaluation by combining the cyan toner, the magenta toner A, and the magenta toner B. The amount of carrier added in each of the developing agents 1 to 5 is 185.0 g.

In the developing agent 1, the amount of the cyan toner is 15.0 g and other toners are not contained. In the developing agents below, only the amount of toner added is described, and the amount of toner not added is not mentioned. In the developing agent 2, the amount of the magenta toner A is 15.0 g. In the developing agent 3, the amount of the magenta toner B is 15.0 g. In the developing agent 4, the amount of the cyan toner is 7.5 g and the amount of the magenta toner A is 7.5 g. In the developing agent 5, the amount of the cyan toner is 7.5 g and the amount of the magenta toner B is 7.5 g.

In this embodiment, the carrier is prepared by pulverizing 50 mol % of iron oxide (manufactured by KDK) serving as a ferrite raw material, 35 mol % of manganese oxide (manufactured by KDK), 14.5 mol % of magnesium oxide (manufactured by KDK), and 0.5 mol % of strontium oxide (manufactured by KDK) using a ball mill for 4 hours to prepare a slurry and drying the resulting slurry using a spray dryer. The obtained spherical particles are calcined using a rotary kiln at 930° C. for 2 hours to obtain a calcined powder. Then, the calcined powder is finely ground using a wet grinding mill (steel balls are used as grinding media) so as to have an average particle size of 1 μm or less to prepare a slurry. PVA is added to the slurry in an amount of 2 wt %. The slurry is granulated and dried using a spray dryer and then fired using an electric furnace at 1100° C. at an oxygen concentration of 0 vol % for 4 hours. Subsequently, disintegration and classification are performed to obtain core particles having a volume-average particle size of 44 μm and a volume resistivity of $1\times10^{9}$ Ω·cm and formed of a ferrite component.

Subsequently, a coating liquid for forming a first-coating layer that coats the core particles is prepared by dissolving and dispersing 100 parts by weight of a silicone resin (number-average molecular weight: about 15000), 3 parts by weight of carbon black (primary particle size: 25 run, oil absorption: 150 ml/100 g) serving as a conductive material, and 5 parts by weight of octylic acid serving as a curing agent in toluene. The core particles are coated with the coating liquid using a spray coating machine. Furthermore, the toluene is completely vaporized to produce a carrier. The produced carrier has a volume-average particle size of 45 μm, a silicone resin coverage of 100%, a volume resistivity of $2\times10^{11}$ Ω·cm, and a saturation magnetization of 65 emu/g.

FIG. 8 is a characteristic table showing the evaluation results of output images.

In this embodiment, the graininess was evaluated for output images formed by using the developing agent 4 and the developing agent 5. That is, whether the unevenness of tinges and the like were reduced was checked for the developing agents containing two or more toners in a mixed manner. Furthermore, an effect of improving the output image by performing a dithering (dither) process was checked. The dithering process will be described in detail together with FIG. 9 described later.

In the evaluation, the Rc value was defined based on the evaluation result of graininess. In other words, a small graininess indicates good uniformity. The Rc value decreases as the graininess decreases. The Rc value is given by formula "$Rc=SQRT((Gr^2+Mo^2)/2)$" that uses a graininess (Gr value) and a mottle (Mo value) measured by a method conforming to ISO/IEC TS 24790. In the above formula, Rc represents an Rc value, Gr represents a Gr value, and Mo represents an Mo value. SQRT( ) is a function of determining the square root of a value in the parentheses.

The evaluation was performed on Evaluation Example 1, Evaluation Example 2, Comparative Example 1, and Comparative Example 2. In Evaluation Example 1, the developing agent 5 was used and "no" image processing was performed. In Evaluation Example 2, the developing agent 5 was used and the dithering process was performed. In Comparative Example 1, the developing agent 4 was used and "no" image processing was performed. In Comparative Example 2, the developing agent 4 was used and the dithering process was performed. The output image in the evaluation was a blue halftone solid image.

In Evaluation Example 1, the Gr value was about 1.35, the Mo value was about 0.53, and the Rc value was about 1.02. In Evaluation Example 2, the Gr value was about 1.16, the Mo value was about 0.40, and the Rc value was about 0.87. In Comparative Example 1, the Gr value was about 1.67, the Mo value was about 0.47, and the Rc value was about 1.23. In Comparative Example 2, the Gr value was about 1.72, the Mo value was about 0.57, and the Rc value was about 1.28.

As described above, the Rc value in Evaluation Example 1 and Evaluation Example 2 is lower than that in Comparative Example 1 and Comparative Example 2. Thus, it can be judged that a uniform, color is obtained by using the developing agent 5. Since substantially the same Rc value is obtained in Comparative Example 1 and Comparative Example 2, an effect of improvement due to the dithering process is not confirmed. However, the Rc value is lower in Evaluation Example 2 than in Evaluation Example 1, and thus an effect of improvement due to the dithering process can be confirmed.

In this embodiment, the first developing characteristic GT1 of the first toner and the second developing characteristic GT2 of the second toner have different slopes and intersect each other. Therefore, the development densities of the first toner and the second toner can be adjusted by appropriately controlling the potentials of two toners having different developing characteristics using a potential controller disposed in the developing device 10, thereby providing a desired tinge. The potential controller is stored in advance as a program in a CPU disposed in the image forming apparatus 1 or the developing device 10, and the stored program is executed.

As described above, the first toner and the second toner may be accommodated in the same cartridge. In this case, the toners having two different colors can be mixed with each other to provide a single-color toner. Even when a toner prepared by mixing toners having two different colors is used, the development density is differentiated by changing the potential, and thus the tinge can be adjusted.

The proper use of the first potential V1 and the second potential V2 allows appropriate selection of a toner whose development density is to be increased.

Figure 9:
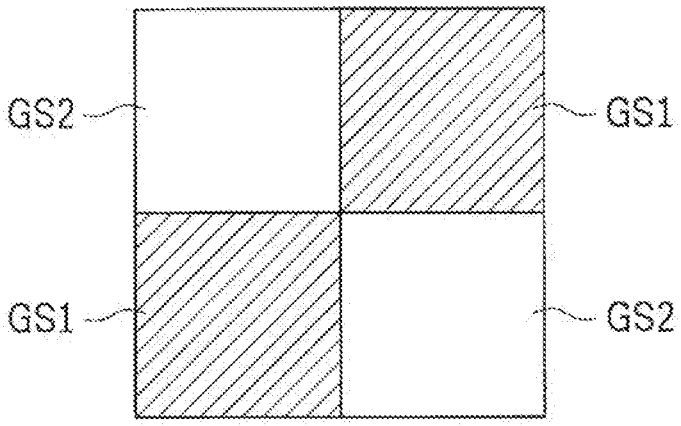
FIG. 9 schematically illustrates one example of a dithering pattern.

FIG. 9 schematically illustrates one example of a dithering pattern. In FIG. 9, first pixels GS1 are hatched to distinguish the first pixels GS1 from, second pixels GS2.

The image forming apparatus 1 includes a hue adjuster (not illustrated) that adjusts the hue by changing a ratio of the first pixels GS1 and the second pixels GS2 arranged, the first pixels GS1 being formed at the first potential V1 and the second pixels GS2 being formed at the second potential V2. The hue adjuster may perform a dithering process on the output image. In the dithering process, a plurality of pixels having different hues are arranged in a scattered manner, and users recognize the scattered arrangement of colors as a mixture of colors. The hue adjuster is stored in advance as a program, in a CPU disposed in the image forming apparatus 1 or the developing device 10, and the stored program is executed.

FIG. 9 illustrates one example of a dithering pattern in the dithering process and four pixels constitute one unit. In the dithering pattern, the four pixels are arranged in a 2×2 matrix. Blue first pixels GS1 with a strong cyan are arranged at the upper right and the lower left. Blue second pixels GS2 with a strong magenta, are arranged at the upper left and the lower right. That is, in the dithering pattern, the first pixels GS1 and the second pixels GS2 are arranged in a staggered pattern like a checked pattern. This is recognized by users as a blue color obtained, by mixing the first pixels GS1 and the second pixels GS2. As described above, various hues can be produced by appropriately forming pseudo two-color pixels through the setting of the potential.

Figure 10:
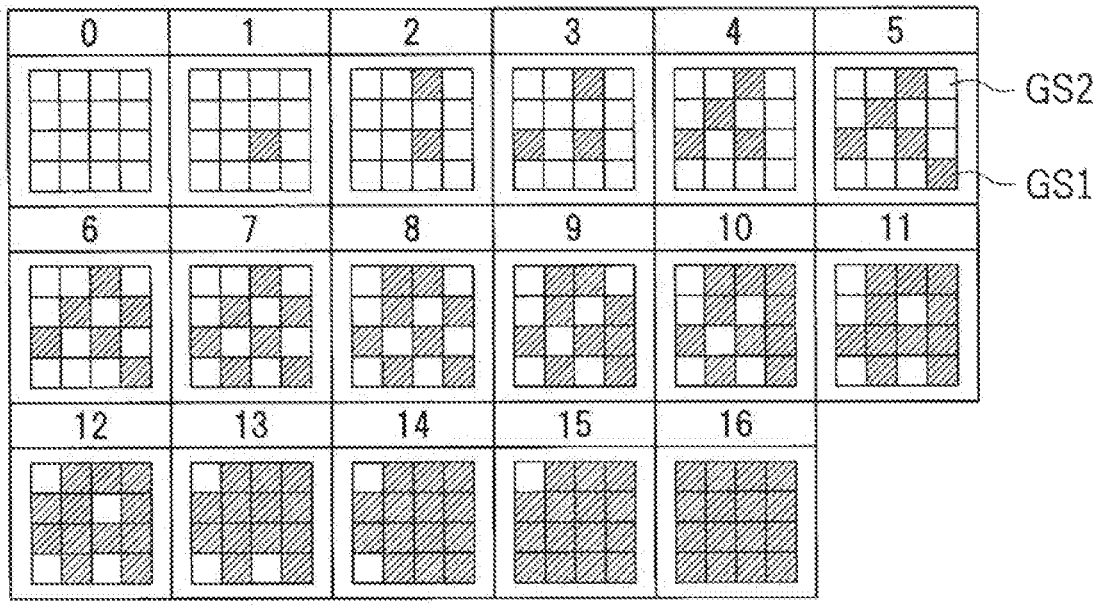
FIG. 10 is a schematic diagram illustrating one example of an array in a density pattern method.

FIG. 10 is a schematic diagram illustrating one example of an array in a density pattern method.

In the hue adjuster, the halftone may be expressed by a density pattern method. In the array in a density pattern method illustrated in FIG. 10, the array of pixels in a 4×4 matrix constitutes one unit and includes arrays "0" to "16". In the array "0", all the 16 pixels are the second pixels GS2. In the array "1", 1 pixel of 16 pixels is the first pixel GS1 and the remaining 15 pixels are the second pixels GS2. That is, the proportion of the first pixels GS1 in the 16 pixels increases as the array changes from "0" toward "16". In the array "16", all the 16 pixels are the first pixels GS1. As described above, by changing the ratio of the first pixels GS1 and the second pixels GS2, the hue recognized by users can be adjusted and thus the halftone can be expressed.

Second Embodiment

Next, an image forming apparatus and a developing device according to a second embodiment of the present disclosure will be described with reference to the attached drawings.

In the second embodiment, the formulation of the toner is different from that in the first embodiment. Since the second embodiment has substantially the same configuration as the first embodiment illustrated in FIG. 1 to FIG. 10, the drawings are omitted.

Figures 11, 12:
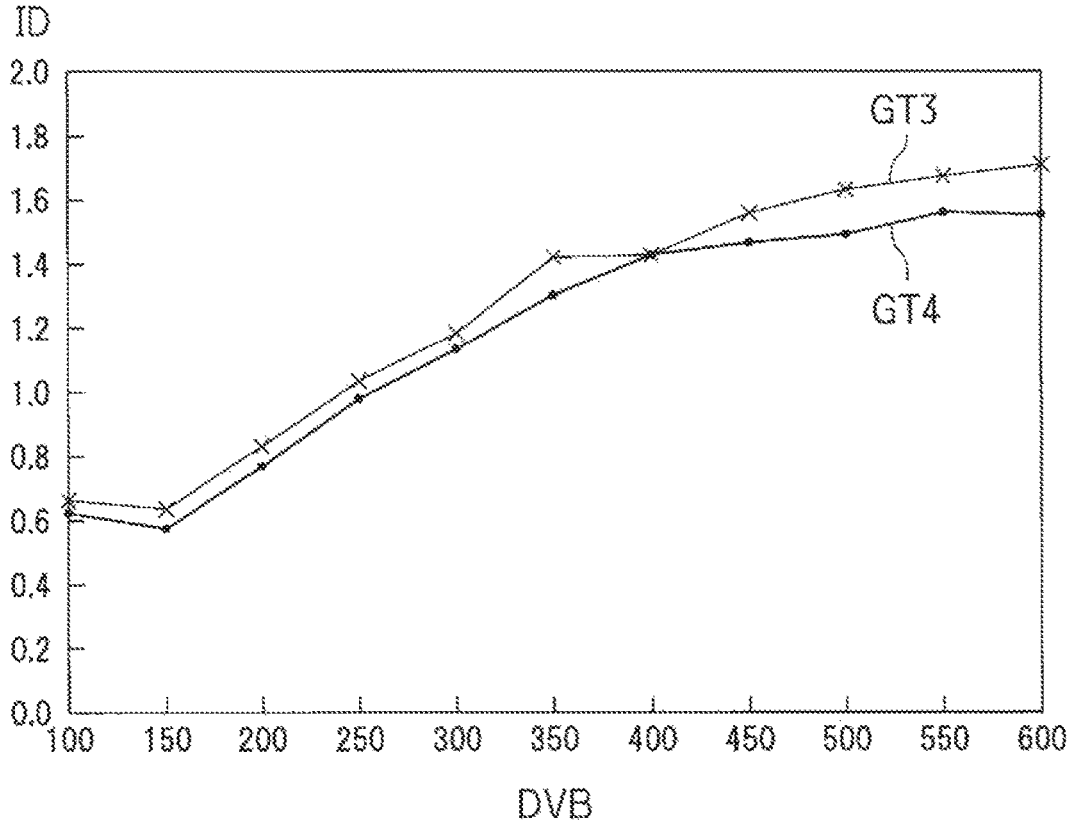
FIG. 11 is a characteristic table showing the formulation of each toner in a developing device according to a second embodiment of the present disclosure.
FIG. 12 is a characteristic diagram, illustrating the developing characteristics of the toners in FIG. 11.

FIG. 11 is a characteristic table showing the formulation of each toner in a developing device according to the second embodiment of the present disclosure. FIG. 12 is a characteristic diagram illustrating the developing characteristics of the toners in FIG. 11.

In the second embodiment, toner particles are mainly formed of a high-molecular-weight polyester resin, a low-molecular-weight polyester resin, a crystalline polyester resin, and an ester wax. For the toner particles in the second embodiment, a toner A and a toner B contain high-molecular-weight polyester resins having different weight-average molecular weights (Mw).

Specifically, the toner A has a weight-average molecular weight of 50000 to 80000, a resistance of $4.5\times10^7$ Ω·cm$^3$, and an amount of electric charge of 27.1 μC/g. The toner B has a weight-average molecular weight of 40000 to 70000, a resistance of $5.1\times10^7$ Ω·cm$^3$, and an amount of electric charge of 32.7 μC/g.

As described above, by differentiating the weight-average molecular weight of the high-molecular-weight polyester resin, the toner A and the toner B have different resistances and thus have different amounts of electric charge. The amount of the toner A that adheres to the photoconductor drum 13 is differentiated from the amount of the toner B that adheres to the photoconductor drum 13 because of the difference in the amount of electric charge.

FIG. 12 illustrates a third developing characteristic GT3 corresponding to the toner A and a fourth developing characteristic GT4 corresponding to the toner B. The change in development density is different between the third developing characteristic GT3 and the fourth developing characteristic GT4. By differentiating the weight-average molecular weight of the high-molecular-weight polyester resin, the developing characteristics of toners can be adjusted. In the developing device 10, two toners may be selected so as to have an appropriate combination of developing characteristics. When the weight-average molecular weight of the high-molecular-weight polyester resin is differentiated, the weight-average molecular weight may be selected from the range of 20000 to 200000.

Third Embodiment

Next, an image forming apparatus and a developing device according to a third embodiment of the present disclosure will be described with reference to the attached drawings.

In the third embodiment, the formulation of the toner is different from that in the first embodiment. Since the third embodiment has substantially the same configuration as the first embodiment illustrated in FIG. 1 to FIG. 10, the drawings are omitted.

FIG. 13 is a characteristic table showing the formulation of each toner in a developing device according to the third embodiment of the present disclosure.

In the second embodiment, the weight-average molecular weight of the high-molecular-weight polyester resin of the toner particles is differentiated. Instead, other factors may be changed to adjust the developing characteristics. In the third embodiment, formulations 1 to 4 different from those in the second embodiment are used.

In the formulation 1, the weight-average molecular weight of the low-molecular-weight polyester resin is increased by 200 from the original weight-average molecular weight. As a result, the resistance of the original toner is $4.3\times10^7$ Ω·cm$^3$ whereas the resistance of the changed toner is $4.5\times10^7$ Ω·cm$^3$. When the weight-average molecular weight of the low-molecular-weight polyester resin is changed, the weight-average molecular weight may be selected from the range of 5000 to 20000.

In the formulation 2, the amount of the ester wax is decreased by 1% from the original amount. As a result, the resistance of the original toner is $4.5\times10^7$ Ω·cm$^3$ whereas the resistance of the changed toner is $4.9\times10^7$ Ω·cm$^3$. The content of the wax is 2% to 5% relative to the weight of the toner.

In the formulation 3, the amount of the crystalline polyester resin is decreased by 6% from the original amount. As a result, the resistance of the original toner is $4.5\times10^7$ Ω·cm$^3$ whereas the resistance of the changed toner is $5.6\times10^7$ Ω·cm$^3$. The crystalline polyester resin has a weight-average molecular weight of 20000 to 50000, and the content of the crystalline polyester resin is 0% to 10% relative to the weight of the toner.

In the formulation 4, the amount of the low-molecular-weight polyester resin is increased by 20% from the original amount. As a result, the resistance of the original toner is $4.0\times10^7$ Ω·cm$^3$ whereas the resistance of the changed toner is $4.5\times10^7$ Ω·cm$^3$.

In the formulation 4, the total amount of the high-molecular-weight polyester resin and the low-molecular-weight polyester resin is fixed. For example, when the amount of the low-molecular-weight polyester resin is increased, the amount of the high-molecular-weight polyester resin is decreased. That is, in the formulation 4, the mixing ratio of the high-molecular-weight polyester resin and the low-molecular-weight polyester resin in the toner is changed. The mixing ratio of the high-molecular-weight polyester resin and the low-molecular-weight polyester resin in the toner (high-molecular-weight polyester resin:low-molecular-weight polyester resin) may be set to "38:62" to "94:6".

The method for adjusting the developing characteristics is not limited thereto. For example, the amount of a charge control agent (CCA) added may be changed. The content of CCA is 0% to 10% relative to the weight of the toner.

In the developing device 10, it is sufficient that two toners having different developing characteristics are used. For example, the original toner is used as a first toner and the changed toner is used as a second toner in any one of the formulations.

The embodiments disclosed herein are illustrative in all aspects and do not constitute grounds for limitative interpretations. Therefore, the technical scope of the present disclosure is not interpreted based on only the above embodiments, but is defined based on the claims. Furthermore, all modifications within the meaning and range of equivalency of the claims are included.

The present disclosure contains subject matter related to that disclosed in Japanese Priority Patent Application JP 2018-101774 filed in the Japan Patent Office on May 28, 2018, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A developing device comprising:

a first toner and a second toner that have different hues;

an image forming section that receives the first toner and the second toner;

an image carrier disposed so as to face the image forming section;

a charging unit that charges a surface of the image carrier; and a potential controller that controls a potential between the image forming section and the image carrier, wherein, for the first toner and the second toner, when a correlation between the potential that is changed by the potential controller and a development density is assumed to be a developing characteristic, a developing characteristic of the first toner and a developing characteristic of the second toner have different slopes and intersect each other.

2. The developing device according to claim 1, wherein the first toner and the second toner are accommodated in the same cartridge.

3. The developing device according to claim 1, wherein the potential controller controls the potential to a first potential at which the first toner has a higher development density than the second toner or a second potential at which the second toner has a higher development density than the first toner.

4. The developing device according to claim 3, comprising a hue adjuster that adjusts a hue by changing a ratio of a first pixel and a second pixel arranged, the first pixel being formed at the first potential and the second pixel being formed at the second potential.

5. The developing device according to claim 1, wherein the developing characteristics of the first toner and the second toner are differentiated by differentiating an amount of an external additive containing any of fumed silica, colloidal silica, titanic, alumina, strontium titanate, and a resin fine particle.

6. The developing device according to claim 1, wherein the developing characteristics of the first toner and the second toner are differentiated by differentiating a mixing ratio of a high-molecular-weight polyester resin and a low-molecular-weight polyester resin.

7. The developing device according to claim 1, wherein the developing characteristics of the first toner and the second toner are differentiated by differentiating a molecular weight of a high-molecular-weight polyester resin and/or a low-molecular-weight polyester resin.

8. The developing device according to claim 1, wherein the developing characteristics of the first toner and the second toner are differentiated by differentiating an amount of a crystalline polyester resin added.

9. The developing device according to claim 1, wherein the developing characteristics of the first toner and the second toner are differentiated by differentiating an amount of a wax added.

10. The developing device according to claim 1, wherein the developing characteristics of the first toner and the second toner are differentiated by differentiating an amount of a charge control agent added.

11. An image forming apparatus comprising developing device according to claim 1.

12. A developing device comprising:

a first toner and a second toner that have different hues;

a toner cartridge that accommodates the first toner and the second toner;

an image forming section that receives the first toner and the second toner from the toner cartridge;

an image carrier;

a charger for charging the image carrier; and a potential controller for controlling a potential of the charger, wherein, for the first toner and the second toner, when a correlation between a potential and a development density is assumed to be a developing characteristic, a developing characteristic of the first toner and a developing characteristic of the second toner have different slopes and intersect each other.

13. The developing device according to claim 12, wherein the potential controller controls the potential to a first potential at which the first toner has a higher development density than the second toner or a second potential at which the second toner has a higher development density than the first toner.

14. The developing device according to claim 13, comprising a hue adjuster for adjusting a hue by changing a ratio of a first pixel and a second pixel arranged, the first pixel being formed at the first potential and the second pixel being formed at the second potential.

* * * * *